US006901992B2

(12) United States Patent
Kent et al.

(10) Patent No.: US 6,901,992 B2
(45) Date of Patent: Jun. 7, 2005

(54) FASTENERLESS MOUNTING BRACKET FOR HEAT EXCHANGERS

(75) Inventors: Scott Edward Kent, Albion, NY (US); David A. Southwick, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 30 days.

(21) Appl. No.: 10/606,076

(22) Filed: Jun. 25, 2003

(65) Prior Publication Data

US 2004/0261973 A1 Dec. 30, 2004

(51) Int. Cl.[7] ..... F28F 9/007
(52) U.S. Cl. ..... 165/67; 180/68.4
(58) Field of Search ..... 165/67; 180/68.4

(56) References Cited

U.S. PATENT DOCUMENTS

| | | | | |
|---|---|---|---|---|
| 5,069,275 A | * | 12/1991 | Suzuki et al. | 165/67 |
| 5,183,103 A | * | 2/1993 | Tokutake | 165/67 |
| 5,205,349 A | * | 4/1993 | Nagao et al. | 165/67 |
| 5,487,422 A | | 1/1996 | Bertva et al. | 165/67 |
| 6,273,182 B1 | | 8/2001 | Pautler et al. | |
| 6,318,450 B1 | | 11/2001 | Acre | |
| 6,510,891 B2 | | 1/2003 | Anderson et al. | |
| 6,513,579 B1 | * | 2/2003 | Kent et al. | 165/67 |
| 6,691,767 B2 | * | 2/2004 | Southwick et al. | 165/67 |
| 2001/0004010 A1 | | 6/2001 | Halm | 165/67 |

FOREIGN PATENT DOCUMENTS

| | | |
|---|---|---|
| EP | 0440400 | 8/1991 |
| EP | 0484004 | 5/1992 |
| EP | 1176379 | 1/2002 |
| EP | 1291204 | 3/2003 |
| JP | 05039993 | 2/1993 |
| JP | 2002168584 | 6/2002 |
| JP | 2002168589 | 6/2002 |

* cited by examiner

*Primary Examiner*—Allen J. Flanigan
(74) *Attorney, Agent, or Firm*—Patrick M. Griffin

(57) ABSTRACT

An integral plastic bracket, generally indicated at (34) in FIGS. 1–6 and at (134) in FIGS. 7–9, is in gripping engagement with each of first and second manifolds. Each bracket and includes a pocket complementary to and surrounding the associated manifold or and a pair of spaced flanges extending from the pocket to engage the faces of the heat exchanger core. Each bracket and also includes a plurality of recesses disposed about projections along the manifolds and for preventing the bracket and from moving along the associated manifold. The flanges have inside surfaces engaging the faces of the heat exchanger core that are closer together at a distance (B) than the transverse dimension (A) of the manifolds and for retaining the bracket and on the heat exchanger core.

6 Claims, 4 Drawing Sheets

FASTENERLESS MOUNTING BRACKET FOR HEAT EXCHANGERS

TECHNICAL FIELD

This invention relates to automotive air conditioning in general, and specifically to a novel design for automotive heat exchanger mounting and support brackets.

BACKGROUND OF THE INVENTION

Automotive heat exchangers comprise a basic central core comprised of regularly spaced tubes and intermediate corrugated air fins, framed on four sides by a pair of parallel header tanks. Although this invention is intended for any similar heat exchanger it has particular utility with a condenser. Typically, the condenser header tanks are vertically oriented, and the tubes horizontally oriented. Some means is necessary to mount to condenser physically to the vehicle, generally in front of the engine-cooling radiator. The condenser may be mounted directly to the vehicle frame, or indirectly mounted to the vehicle by mounting to the radiator. Whether it's directly or indirectly mounted to the vehicle, the condenser generally requires several brackets, securely fixed to its core structure, which can in turn receive threaded bolts or other fasteners to allow the condenser to be fixed in place.

The alternatives for providing mounting brackets on the condenser include extruding the header tank with integral rails, or attaching separate brackets. Integral rails are heavy, being the full length of the extruded tank, an example of which may be seen in U.S. Pat. No. 5,671,803. Much of the weight of an extruded header tank rail can be processed away in a post extrusion manufacturing step, leaving only a discrete flange, but the extra step adds expense. Most separate mounting brackets are metal pieces that are somehow fixed to the header tank before the brazing operation and then brazed on solidly later. Numerous examples may be seen in the prior art, as in U.S. Pat. No. 5,205,349. The addition of discrete, localized metal masses to an otherwise regular metal part is undesirable in that it can introduce irregularities in the braze temperature profile, as well as interfere with the smooth stacking and running of parts on the conveyor belt. Separate mounting brackets may also be attached after the brazing operation, as shown in U.S. Pat. No. 5,535,819, where metal brackets are bolted to the condenser reinforcement after the braze operation. One or more fasteners are needed for each of four brackets, which involves considerably more labor than simply snapping a bracket to a header tank prior to the braze operation. One recent U.S. Pat. No. 6,202,737, shows a condenser attached to a radiator tank with a bracket that is described as being "nested" on top of the condenser tank before being snapped to the radiator tank. It is unclear what "nesting" means, and unclear what material is used in the bracket. Yet another development is disclosed in U.S. Pat. No. 6,513,579, wherein a plastic mounting bracket that is press fit onto each corner of the condenser addresses some of these problems. These plastic brackets are simple and light molded pieces that are attached to the corners of condenser core entirely post braze, in a simple press fit operation that needs no separate fasteners. Each bracket has a cap that fits closely over the end of header tank and an integral channel on the side that snap fits over the core reinforcement, with no additional fasteners needed. Once installed to the condenser core, the plastic brackets gain solid twisting resistance from both sides of the condenser corner, as well as solid removal resistance from the close, snap fit. There remains a need for simple and effective mounting arrangements for heat exchangers that avoid the use of fasteners and accommodate brazing and processing of the heat exchanger core.

SUMMARY OF THE INVENTION AND ADVANTAGES

The subject invention provides a unique mounting system for a heat exchanger assembly comprising a heat exchanger core having opposite faces surrounded by ends and sides with a first header manifold disposed at one side of the heat exchanger core and a second header manifold 30 in parallel relationship to the first header manifold and disposed along the other side of the heat exchanger core. Each of said manifolds has a constant cross section along the length thereof and at least one projection disposed along the first manifold. A plastic bracket grips the first manifold and includes at least one recess disposed about the projection for preventing the bracket from moving along the manifold.

The subject invention allows the use of a plastic bracket in combination with a header manifold of simple cross section without rails or extensions whereby the manifold may be extruded, made in a tube mill, or the like, in a continuous and constant cross section. The bracket is attached without the use of any fasteners.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
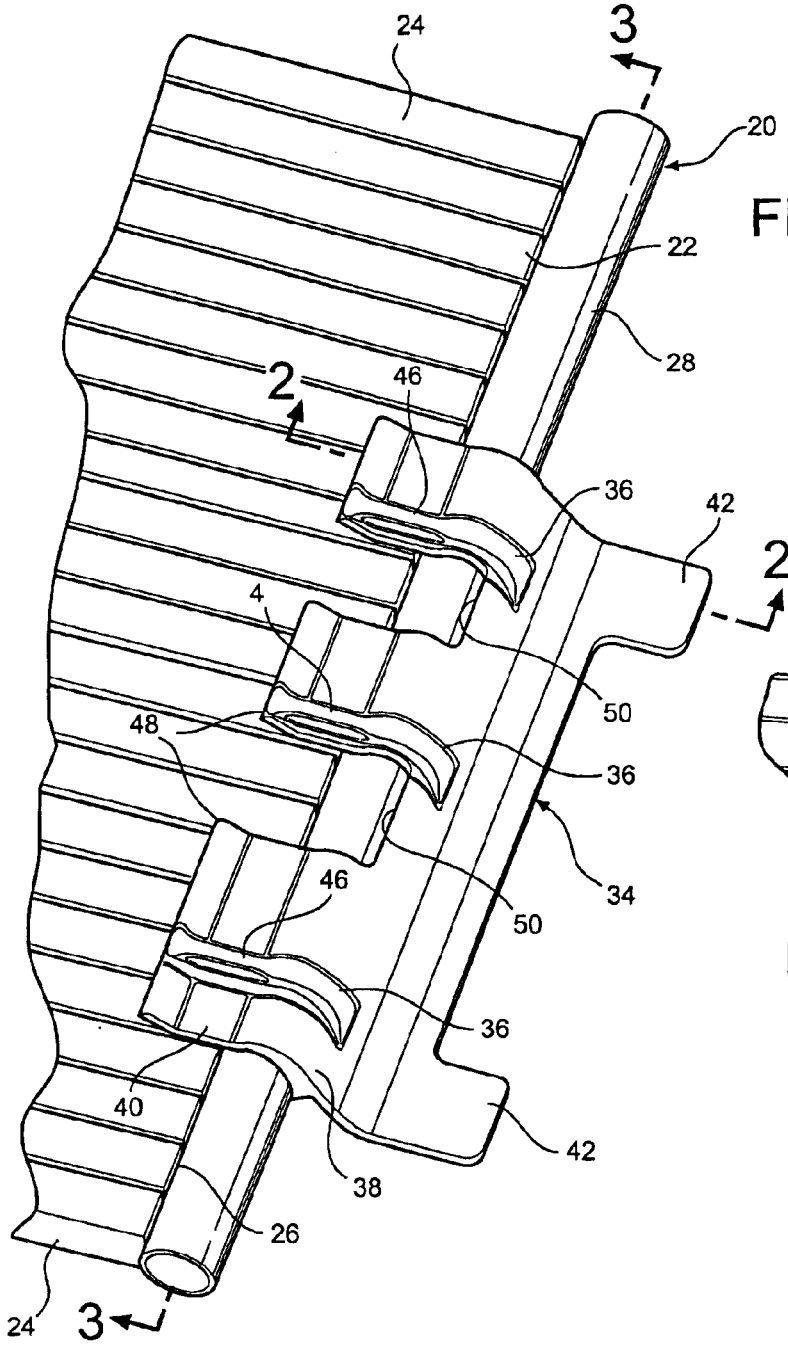
FIG. 1 is a perspective view of a first embodiment of the invention.
Figure 5:
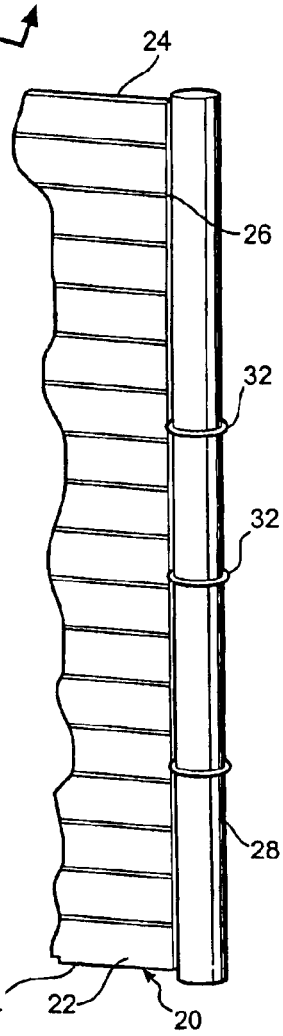
FIG. 5 is perspective view of the heat exchanger core without the bracket attached thereto.
Figure 2:
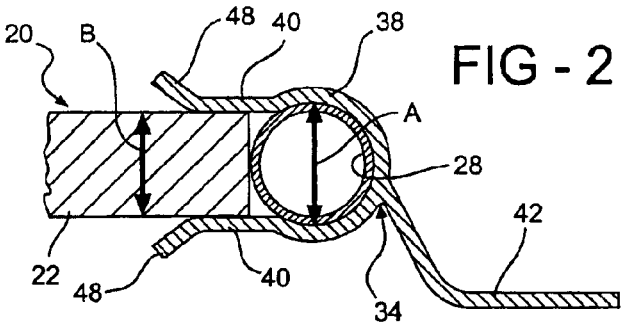
FIG. 2 is a cross sectional view taken along line 2—2 of FIG. 1.
Figure 3:
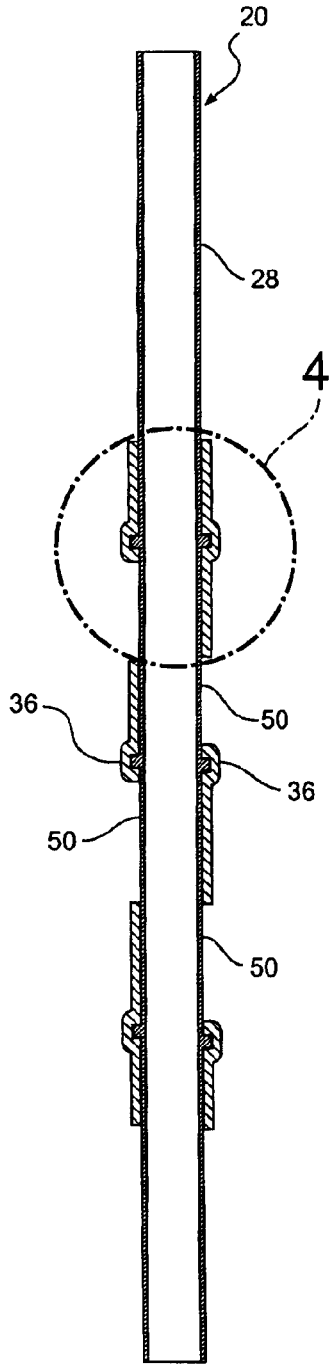
FIG. 3 is a cross sectional view taken along line 3—3 of FIG. 1.
Figure 4:
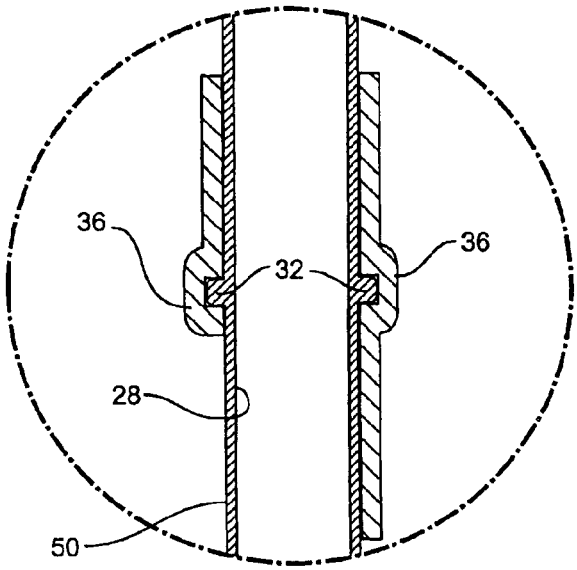
FIG. 4 is a close-up view of FIG. 3.
Figure 6:
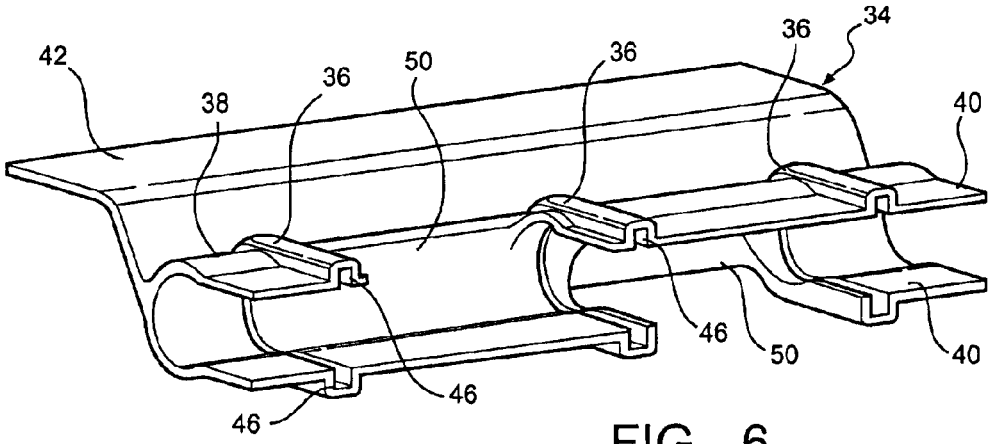
FIG. 6 is perspective view of the bracket only.

Referring to the drawings wherein like numerals indicate like or corresponding parts throughout the several views, an automotive heat exchanger or condenser assembly is generally indicated at 20. The heat exchanger assembly 20 comprises a heat exchanger core 22 having opposite faces surrounded by ends 24 and sides 26, the core 22 being of the well known type including tubes and fins. A first header manifold 28 is disposed at one side 26 of the heat exchanger core 22 and a second header manifold 30 is in parallel relationship to the first header manifold 28 and is disposed along the other side of the heat exchanger core 22. As is well known in the art, the core 22 includes tubes for conveying fluid between the manifolds 28 and 30, 28 and 30 and fins on the tubes for effective heat transfer. Each of the manifolds 28 and 30 has a constant cross section along the length thereof. More specifically, the cross section is circuitous or endless, as in a circle or oval. Each manifold 28 and 30 has a transverse dimension (A) perpendicular to the faces of the heat exchanger core 22 which is larger than the distance (B) between the faces of the core 22.

A plurality of projections 32 are disposed along each of the manifolds 28 and 30. The projections 32 take the form of beads formed in the pipe defining the manifolds 28 and 30 or collars, rings or separator ears added prior to brazing. Alternatively, the projections can project inwardly to define grooves or valleys. In yet another alternative, locating ears as part of the separator could be used.

Figure 7:
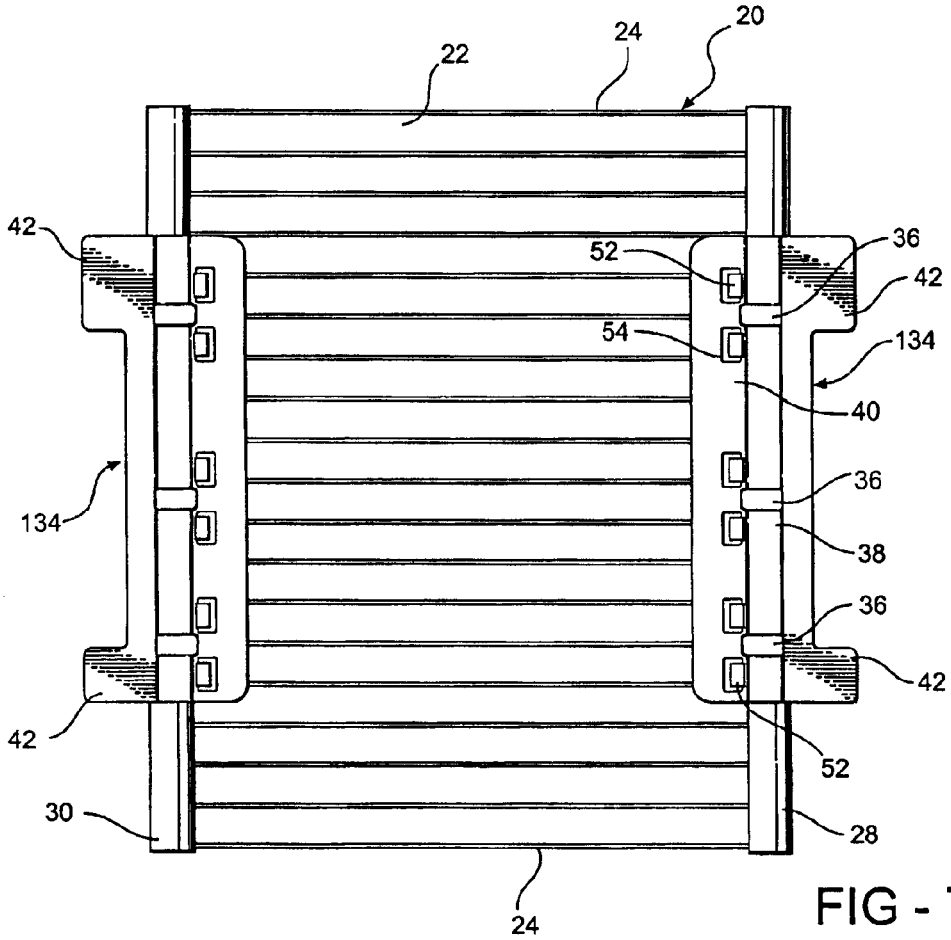
FIG. 7 is a frontal view of a heat exchanger assembly incorporating a second embodiment of the bracket.
Figure 8:
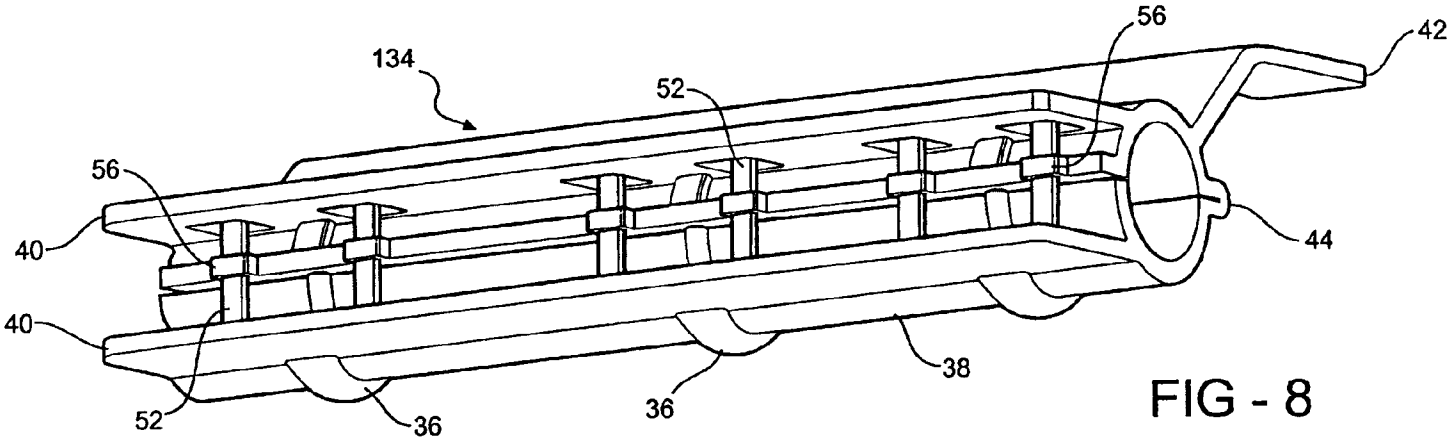
FIG. 8 is perspective view of the second embodiment of the bracket shown in the closed position.
Figure 9:
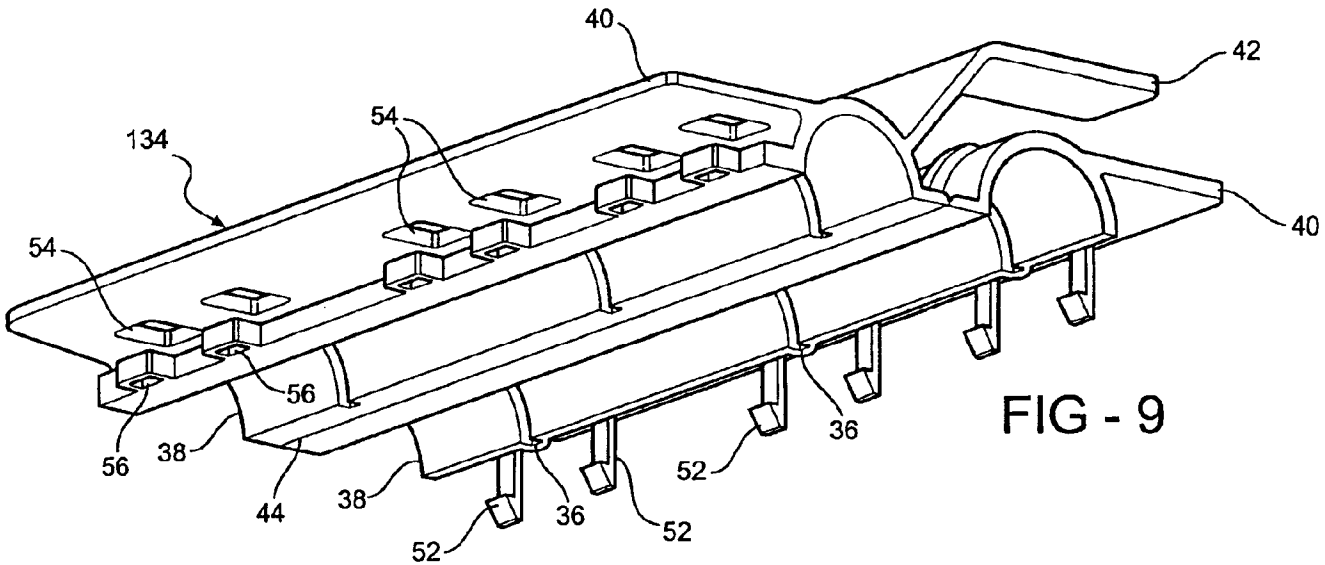
FIG. 9 is perspective view of the second embodiment of the bracket shown in the open position.

A plastic bracket, generally indicated at 34 in FIGS. 1–6 and at 134 in FIGS. 7–9, is in gripping engagement with each of the first manifold 28 and the second manifold 30. The bracket 34 and 134 includes a plurality of recesses 36 disposed about the projection 32 for preventing the bracket 34 and 134 from moving along the associated manifold 28 or 30. The brackets 34 or 134 on opposite sides of the core 22 are mirror images of one another for oppositely gripping the first 28 and second 30 manifolds. Alternatively, the two halves could be identical with the two halves oriented 180° relative to one another. The brackets are integrally molded or one piece plastic components. The design shown in FIGS. 8 & 9 could also be in two pieces instead of being connected by a living hinge.

Each bracket 34 and 134 includes a pocket 38 surrounding the associated manifold 28 or 30 and a pair of spaced flanges 40 extending from the pocket 38 to engage the faces of the heat exchanger core 22. The cross section of each manifold 28 and 30 is round and the pocket 38 is complementary to that roundness shape. The flanges 40 have inside surfaces engaging the faces of the heat exchanger core 22 that are closer together at the distance (B) than the transverse dimension or diameter (A) of the manifolds 28 and 30 for retaining the bracket 34 and 134 on the heat exchanger core 22 and to prevent rotation of the bracket, about the axis of the manifold. In other words, the flanges 40 are closer together (B) than the inside diameter (A) of the pocket 38 in the bracket 34. In the case where the projections 32 extend radially inwardly to define a groove instead of radially outwardly, the recesses 36 would be an inwardly extending duration or rib disposed in the groove.

As will be appreciated the projections 32, whether they be male or female (out or in), define irregularities and the recesses 36, whether they be male or female, define deviations complimentary to one another for locking engagement to prevent longitudinal movement of the bracket 34 along the manifold. Of course, the manifolds 28 and 30 could have other than a circular cross-section.

A support tab 42 extends from the pocket 38 in the opposite direction from the flanges 40 for mounting the bracket 28 or 30 to a support structure of a vehicle.

The bracket 34 of FIGS. 1–6 differs from the bracket 134 of FIGS. 6–9 in that the first embodiment 34 snaps onto the manifold 28 or 30 and is held in place by the frictional clamping forces of the stationary flanges 40 thereof whereas the flanges 40 of the second embodiment are hinged by a living hinge 44 to rotate into clamping engagement with the manifold 28 or 30. As alluded to above, the living hinge could be replaced by a hinge between separate parts, even identical parts. To accommodate the placement of the bracket 34 onto the manifold 28 or 30, the recesses 36 include extensions 46 that extend into the flanges 40 for receiving the projections 32 as the flanges 40 of the bracket 34 separate in sliding over the manifold 28 or 30. In addition, the distal ends of the flanges 40 include outwardly extending flares 48 for facilitating movement of the manifold 28 or 30 into the pocket 38. The first bracket 34 also includes cutouts 50 along the flanges 40. In order to facilitate or simplify molding, the cutouts being staggered along the flanges so that a cutout does not face another cutout, i.e., each cutout is disposed opposite to a flange 40.

As alluded to above, the second embodiment of the bracket shown at 134 in FIGS. 7–9 includes a living hinge 44 to move the flanges 40 thereof in a circular path about the axis of the hinge 44 and into clamping engagement with the opposite faces of the core 22 with the pocket 38 thereof engaging the associated manifold 28 or 30. In order to hold the bracket 134 in the clamping position, a plurality of snap posts 52 extending for one flange 40 have hooked ends that snap into latch holes 54 in the other flange 40. The posts extend through guides 56 in the clamped or locked position, as shown in FIG. 8. The posts 52 extend through openings in the core 22.

Obviously, many modifications and variations of the present invention are possible in light of the above teachings. The invention may be practiced otherwise than as specifically described within the scope of the appended claims.

What is claimed is:

1. A heat exchanger assembly comprising;

a heat exchanger core having opposite faces surrounded by ends and sides, a first header manifold disposed at one side of said heat exchanger core and a second header manifold in parallel relationship to said first header manifold and disposed along the other side of said heat exchanger core, each of said manifolds and having a constant cross section along the length thereof, said first manifold having a transverse dimension (A) perpendicular to said faces of said heat exchanger core that is larger than the distance (B) between said faces;

at least one irregularity disposed along said first manifold, a bracket including a pocket gripping said first manifold and a pair of spaced flanges extending from said pocket and presenting inside surfaces extending over and engaging said faces of said heat exchanger core that are closer together (B) than said transverse dimension (A) of said first manifold for retaining said bracket and on said heat exchanger core, said bracket including at least one deviation extending about said pocket between said flanges and disposed in locking relationship with said irregularity for preventing said bracket and from moving along said manifold.

2. An assembly as set forth in claim 1 wherein said deviation extends into said flanges for sliding said bracket over said irregularity.

3. An assembly as set forth in claim 2 wherein said cross section of said first manifold is round and said pocket is complementary to said first manifold.

4. An assembly as set forth in claim 3 including at least one support tab extending from said pocket in the opposite direction from said flanges.

5. An assembly as set forth in claim 1 including a second bracket or for engaging said second manifold.

6. An assembly as set forth in claim 1 wherein each of said manifolds and has a circular cross section and wherein said irregularity includes a projection extending circularly about said first manifold and said deviation comprises a recess extending about said pocket in said bracket and engaging said projection.

* * * * *